United States Patent [19]

Magidson et al.

[11] 3,939,023

[45] Feb. 17, 1976

[54] METHOD OF CONSTRUCTION OF BRA PAD

[75] Inventors: Herbert Magidson; Otto L. Huber, both of Beverly Hills; Helmut Hennrich, Manhattan Beach, all of Calif.

[73] Assignee: Moldex, Inc., Culver City, Calif.

[22] Filed: Nov. 5, 1973

[21] Appl. No.: 412,666

[52] U.S. Cl. ..... 156/211; 128/480; 128/516; 156/227; 156/245; 156/257; 156/267; 264/324

[51] Int. Cl.[2] ..... A41C 3/00

[58] Field of Search ..... 156/211, 217, 227, 245, 156/257, 258, 267; 264/321, 324; 128/425, 427, 428, 463, 464, 480, 481, 516

[56] References Cited

UNITED STATES PATENTS

| | | | |
|---|---|---|---|
| 2,427,851 | 9/1947 | Gerst | 128/481 |
| 3,312,224 | 4/1967 | Coates et al. | 264/324 |
| 3,392,731 | 7/1968 | Silverman | 128/481 |
| 3,417,755 | 12/1968 | Howard et al. | 128/516 |
| 3,502,083 | 3/1970 | Howard et al. | 128/516 |
| 3,780,741 | 12/1973 | Cole | 128/516 |
| 3,799,174 | 3/1974 | Howard | 156/245 |

*Primary Examiner*—Douglas J. Drummond
*Assistant Examiner*—Basil J. Lewris

[57] ABSTRACT

A method of fabricating a brassiere pad which involves folding a fiberfill blank longitudinally, making an oblique cut at right angles to the fold through one thickness of the blank, folding the blank so as to expose surfaces which are to be bonded, refolding to abut the surfaces to be bonded and molding the resulting form to the desired pad contour. Means for controlling the thickness of the under portion of the pad to provide desired push up action is disclosed.

4 Claims, 9 Drawing Figures

Fig. 1
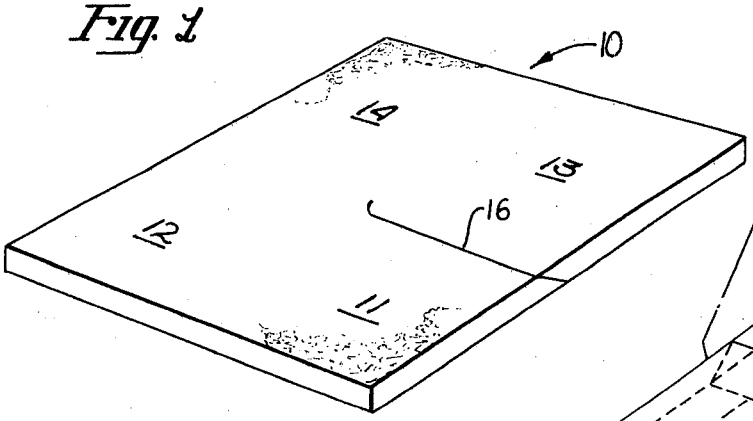
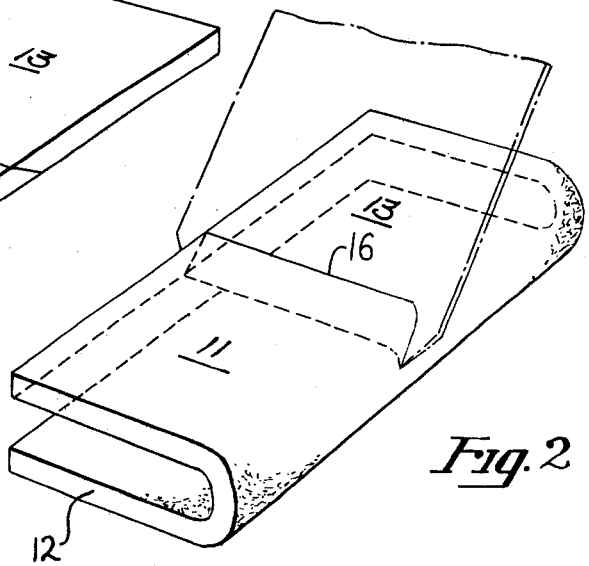
Fig. 2
Fig. 3
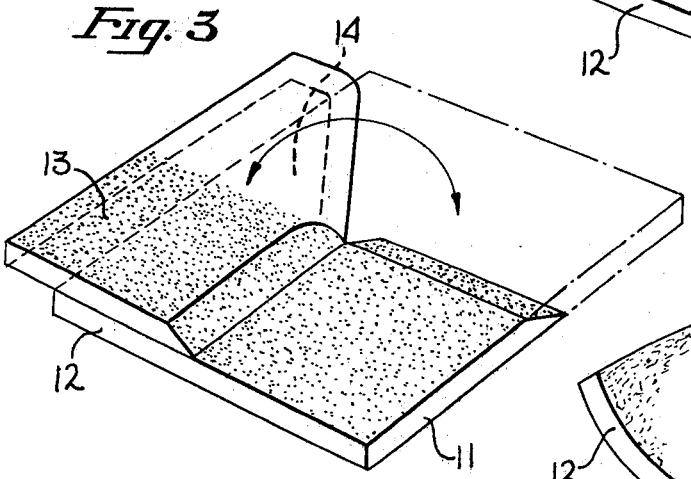
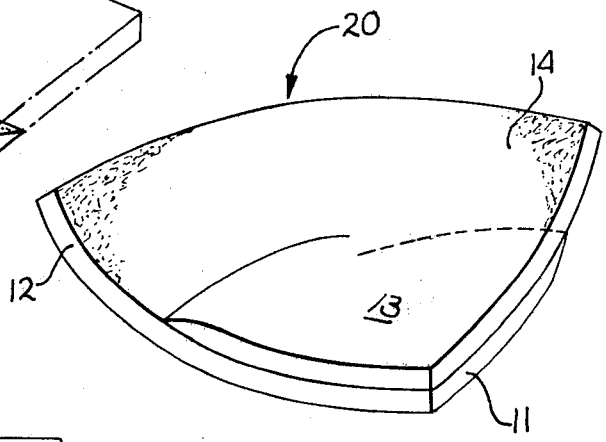
Fig. 4
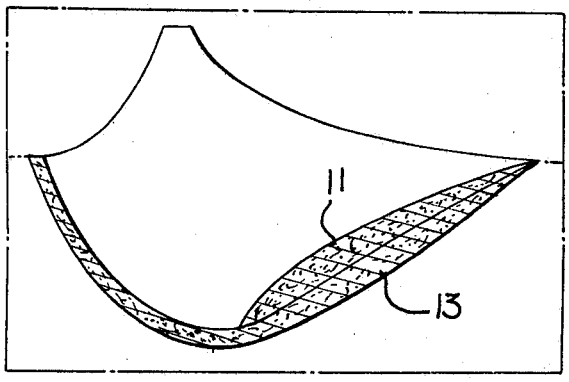
Fig. 5

Fig. 7
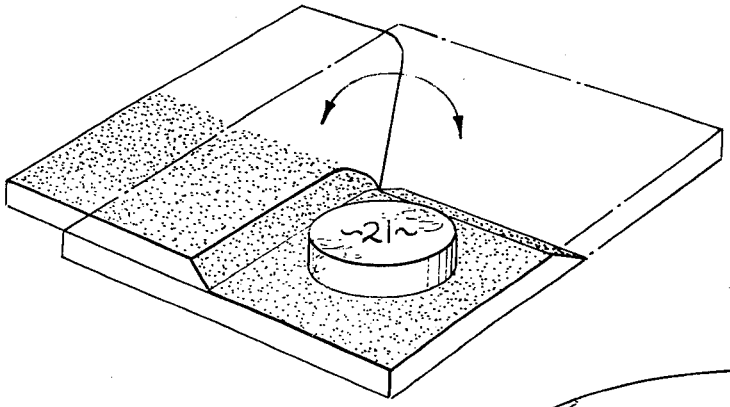
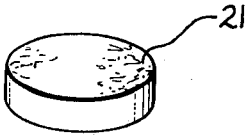
Fig. 6
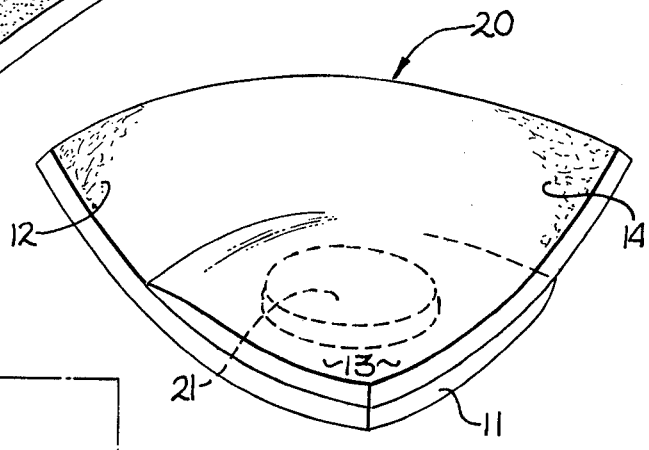
Fig. 8
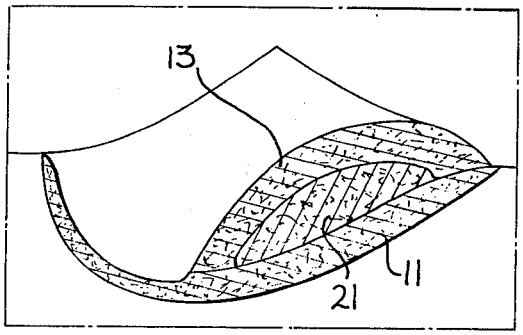
Fig. 9

METHOD OF CONSTRUCTION OF BRA PAD

BACKGROUND OF THE INVENTION

1. Field of the Invention

This invention is related to the field of brassiere pads.

2. Prior Art

Brassiere pads to increase the apparent size of the breast and to cause the top of the breast to appear full have been in use for many years. Originally, the pads were made of flat material sewn into the desired conical shape. Recently, pads have been made of fiberfill or the like sheet material made conical by cutting a pie-shaped segment out of the sheet and gluing together the edges thus obtained. Final forming of the desired pad is achieved by placing the rough conical fiberfill form in a two-piece heated mold which compresses the fiberfill and forms it to the desired contour.

Pads have also been made recently by cutting a single oblique cut in a fiberfull sheet, forming a cone by overlapping the portions of the sheet adjacent to the cut, bonding the cut edges to the surface of the sheet immediately under the edge, and forming a finished pad in a two-piece heated mold. The pad resulting from this last method of fabrication is somewhat similar to the pad resulting from the invented method except that the two layers of overlapping material are not joined except at the edges of the cut, whereas in the present invention the overlapping areas are bonded over the entire surface. The invented method of fabrication as described below, is substantially different from the prior art and produces an improved and more durable pad.

SUMMARY OF THE INVENTION

The invented method of brassiere pad fabrication involves the use of sheet fiberfill or the like material. This material is comprised of loosely packed synthetic fibers which are held together in random orientation by a bonding agent such that a very light springy material is obtained. The character of the material is such that application of heat will soften the bonding agent and pressure can be applied to cause the material to compress and permanently assume the contours of the mold in which it is heated and compressed. The compression can be controlled such that the softness of the resultant material approximates that of the human breast.

By cutting a sheet of such material in a particular way, folding the cut sheet in the manner to be described below, applying bonding agents to selected areas of the folded sheet, folding the sheet further and placing the resulting form in a heated mold to cure it to the desired contour, a brassiere pad can be made having a heavy section on the bottom portion for the purpose of causing the breasts to be pushed upward in the bra, and a thinner tapered section on the upper portion of the pad so that the pad will blend into the top of the breast and the presence of a pad will not be obvious.

It is thus an object of the present invention to provide a method of making brassiere pads which results in a pad having a relatively thick section on the under portion of the pad and a relatively thin section on the upper portion of the pad.

It is another object of the present invention to provide a method of making such a pad which is quick, convenient, and inexpensive to utilize and which allows inexperienced help to be used in the manufacture of the pads.

DESCRIPTION OF THE FIGURES

FIG. 1 is a perspective view of the blank sheet after the oblique cut has been made.

FIG. 2 is a perspective view of the blank showing the oblique cut being made.

FIG. 3 is a perspective view of the blank after bonding agent has been applied to the surfaces to be bonded but before the surfaces are adhered.

FIG. 4 is a perspective view of the pad form before molding.

FIG. 5 is a vertical cross sectional view of a completed bra pad.

FIG. 6 is a perspective view of a filler piece used to provide a thicker under portion of the pad.

FIG. 7 is a pad in the same stage of manufacture as in FIG. 3 with the addition of a filler piece.

FIG. 8 is a perspective view of a pad form including a filler piece.

FIG. 9 is a vertical cross sectional view of a completed pad with filler piece.

DETAILED DESCRIPTION

The bra pad of the present invention is made of fiberfill or the like material. The starting blank 10 as illustrated in FIG. 1 is typically three-fourth inch thick and is about a 9 inch by 11 inch rectangle. The size and thickness will of course vary depending on the desired size of the finished pad. The first step in fabrication according to a presently preferred embodiment of the invented method is to fold the pad lengthwise as shown in FIG. 2 so that the top portions 11 and 13 overlaps the bottom portions 12 and 14 somewhat. The reason for this is that while a bra pad is of generally conical shape, the apex of the pad is usually substantially above the center of the finished pad and thus more material is needed for the bottom half of the pad (which will be the final location of portions 11 and 13) than in the top half of the pad (which will be formed from portions 12 and 14).

Knife 15, shown in phantom lines in FIG. 2, then is used to make a transverse cut 16 through the top layer only (between portions 11 and 13) at about the middle of the length of the blank, and at about an angle of 45 degrees.

The resultant blank, as illustrated in FIG. 1, has a diagonal cut part way across the width of the blank. From the unfolded position, shown in FIG. 1, portion 13 is folded over portion 12, as shown in FIG. 3, the fold being about a line extending in the uncut portion of the blank at an obtuse angle, of about 135°, to the edge of portion 11 formed by cut 16. Due to this folding, the former upper surface of portion 13 is in engagement with the upper surface of portion 12, while the former lower surface of portion 13 is now the upper surface thereof. In this folded position, the two edges of the cut 16 are at right angles to each other. Next, the upper surfaces of portions 11 and 13 are sprayed with a bonding agent suitable for bonding the pad material to itself. The pad is then folded as shown in FIG. 4 with the surfaces which have bonding agent applied butted. The bonding agent is then allow to dry, with heat applied if desired, resulting in a generally conical shaped form 20, one section of the cone being somewhat thicker than the balance because of the overlapping of portions 11 and 13. The transition between the thick section of the cone and the thinner section is not abrupt because of the tapered edges formed by diagonal cut 16.

The form 20 is then placed in a heated two-part mold having the desired contour pad and pressure applied, causing the form 20 to permanently deform and assume the shape of the mold. The thickness of the pad is also reduced, the double layered section remaining thicker than the rest, however. Form 20 is somewhat larger than the desired finished pad size and the mold is made so as to pinch the form 20 tightly at the desired outline of the finished pad, providing a guide for trimming excess material away from the finished pad.

The mold is typically heated to about 250° to 300° F and the form 20 is kept in the mold for about one-half minute. The resins which bond the fibers of the fiberfill material soften when heated in this manner and when the pad is removed from the mold they reharden holding the material in the shape of the mold. Upon being compressed, the fiberfill material also takes on a smoother surface and becomes more rigid, although still soft enough to approximate the softness of the body.

The cross section of the finished pad shown in FIG. 5 illustrates a typical contour of a pad made in accordance with the invented method showing the extra thickness in the bottom portion which serves to push the breast upward giving it a fuller appearance. In use, the pad is normally permanently sewn into a bra cup or positioned in pockets in the cup.

In some cases it is desirable to have more push-up action than is provided by the double layer of material achieved by the method described. In such event a second embodiment of the invented method can be used. This method is illustrated in FIGS. 6 through 9.

In the second embodiment of the invented method, a blank of fiberfill or the like material is used which is identical to that used in the first embodiment. The blank is folded over and cut in the same manner, and subsequently folded to the position of FIG. 8, also the same as is done for the first embodiment. The up-facing surfaces of portions 11 and 13 are sprayed with a suitable bonding agent and a filler 21 is placed on the surface of portion 11. The filler 21 is a piece of material preferably the same as the rest of the pad and preferably approximately circular in shape. The thickness of filler 21 can vary depending upon the amount of push-up action desired in the pad, the more push-up action desired, the thicker will be filler 21.

After positioning filler 21 about in the center of portion 11, portion 11 is folded over portion 13, pressed down somewhat, by hand, to give some initial adhesion and the assembly placed in a two piece heated mold similar to that used for the first embodiment, except of course, the mold is shaped to result in a heavier section in the area of the filler. FIG. 8 illustrates the form just prior to the molding step and FIG. 10 is a cross section of a finished pad showing the effect of filler 21.

The thickness of the original blank material and filler material, if used, is chosen to result in the desired final thicknesses of the various portions of the pad to achieve the proper contour and pushup action and to result in a material density which approximates the softness of a human breast.

What is claimed is:

1. The method of making a bra pad comprising the steps of:

a. making a beveled cut part way across a sheet of fiberfill or the like material, said cut establishing first and second portions of said sheet adjacent to said cut;

b. folding the first of said portions over another part of said sheet and positioning the two edges formed by said beveled cut at right angles to each other, the first portion having a surface thereof in engagement with a surface of said other part of said sheet, the opposite surface of said first portion being exposed and adjacent to the second portion of said sheet;

c. applying a bonding agent to the exposed faces of said first and second portions of said sheet adjacent said beveled cut;

d. forming said sheet into a substantially conical shape by placing said opposite surface of said first portion of said sheet over said second portion and engaging the surfaces of said first and second portions to which bonding agent has been applied;

e. placing said form in a heated mold whereby said material will be molded to the contours of said mold; and f. trimming excess material from said molded form producing a bra pad.

2. The method of making a bra pad as described in claim 1 and further including the step of placing a piece of fiberfill or the like material on the exposed face of said first portion after said bonding agent is applied and before said second portion is folded over said first portion, whereby said piece of material will be secured between said first and second portions producing a heavy section in said form.

3. The method of making a bra pad as described in claim 1 where said beveled cut is made by folding said sheet of material longitudinally and making the beveled cuts through one thickness of said folded sheet, said cut extending from an edge of said sheet to said fold substantially at right angles to said fold.

4. The method of making a bra pad as described in claim 3 and further including the step of placing a piece of fiberfill or the like material on the exposed face of said first portion after said bonding agent is applied and before said second portion is folded over said first portion whereby said piece of material will be secured between said first and second portions producing a heavy section in said form.

* * * * *